US005356309A

United States Patent [19]

Carney et al.

[11] Patent Number: 5,356,309

[45] Date of Patent: Oct. 18, 1994

[54] CONNECTOR BLOCK WITH RELEASABLE MOUNTING

[75] Inventors: William V. Carney, Oyster Bay; Michael Fasano, Huntington, both of N.Y.

[73] Assignee: Porta Systems Corp., Syosset, N.Y.

[21] Appl. No.: 186,597

[22] Filed: Jan. 26, 1994

[51] Int. Cl.[5] ..... H01R 9/26

[52] U.S. Cl. ..... 439/532; 439/716

[58] Field of Search ..... 439/532, 716, 717

[56] References Cited

U.S. PATENT DOCUMENTS

| | | | |
|---|---|---|---|
| 4,118,091 | 10/1978 | Frisby | 439/101 |
| 4,281,885 | 8/1981 | Forberg et al. | 439/95 |
| 4,621,885 | 11/1986 | Szczesny et al. | 439/357 |
| 4,634,209 | 1/1987 | Forberg et al. | 439/61 |
| 4,729,064 | 3/1988 | Singer | 361/426 |
| 4,741,711 | 5/1988 | Singer | 439/620 |
| 5,160,273 | 11/1992 | Carney | 439/108 |

FOREIGN PATENT DOCUMENTS

| | | | |
|---|---|---|---|
| 2510821 | 2/1983 | France | 439/716 |
| 2605464 | 4/1988 | France | 439/716 |

*Primary Examiner*—Gary F. Paumen

*Attorney, Agent, or Firm*—Fitzpatrick, Cella, Harper & Scinto

[57] ABSTRACT

A connector block (20) which contains a plurality of electrical contacts (38) is mounted on mounting tabs (32) of a mounting bracket (22) and is releasably locked in place by means of projections (56) on release tabs (52) at the ends of the block. The release tabs are resiliently bendable away from the end wall to pull the projection (56) out from locking holes (34) in the mounting tabs (32).

22 Claims, 4 Drawing Sheets

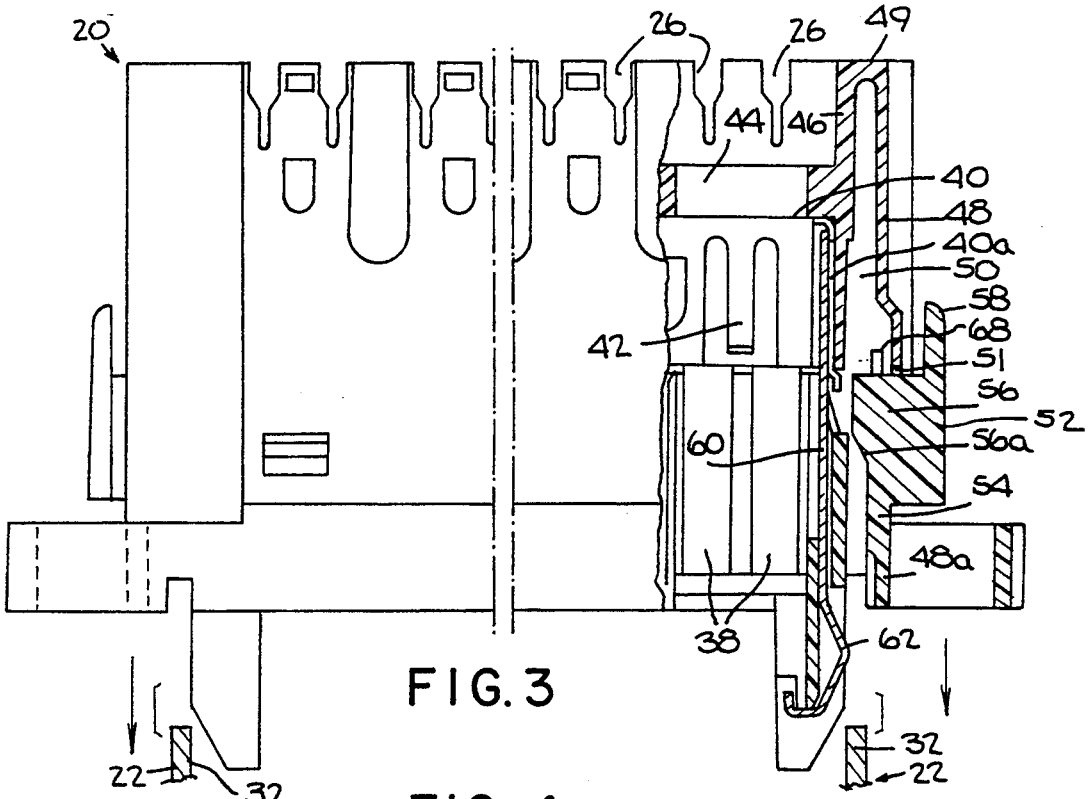
FIG. 3
FIG. 4
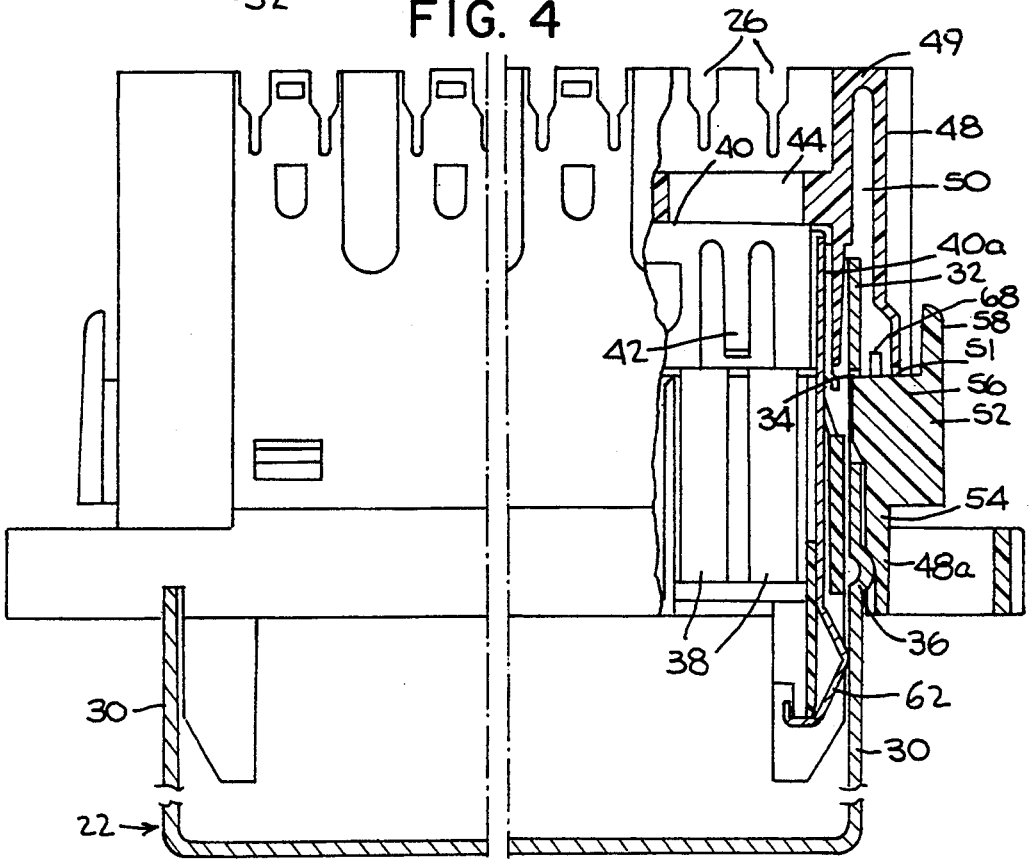

FIG. 5
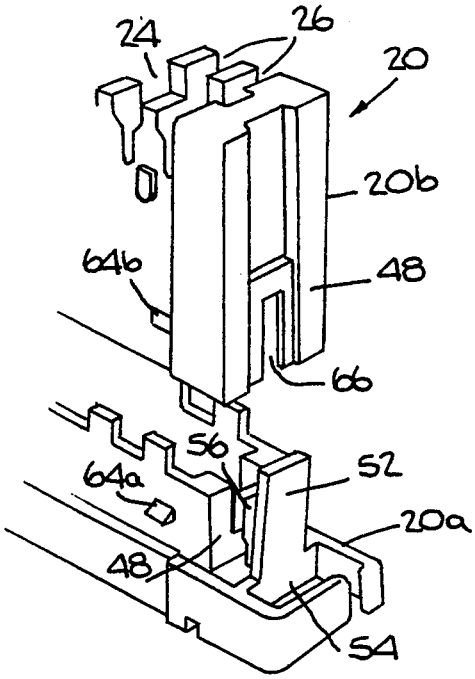
FIG. 6
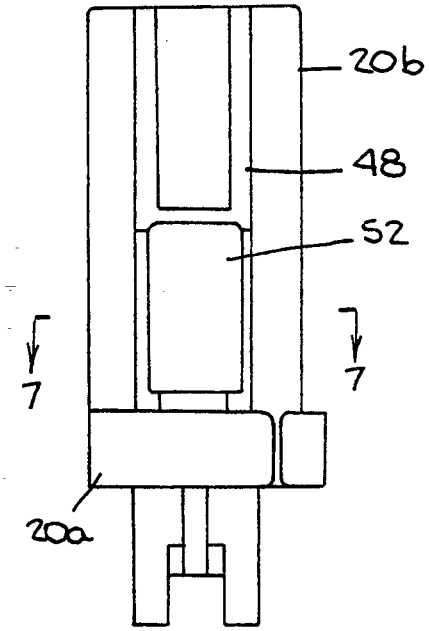
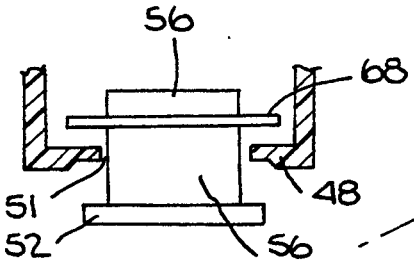
FIG. 7
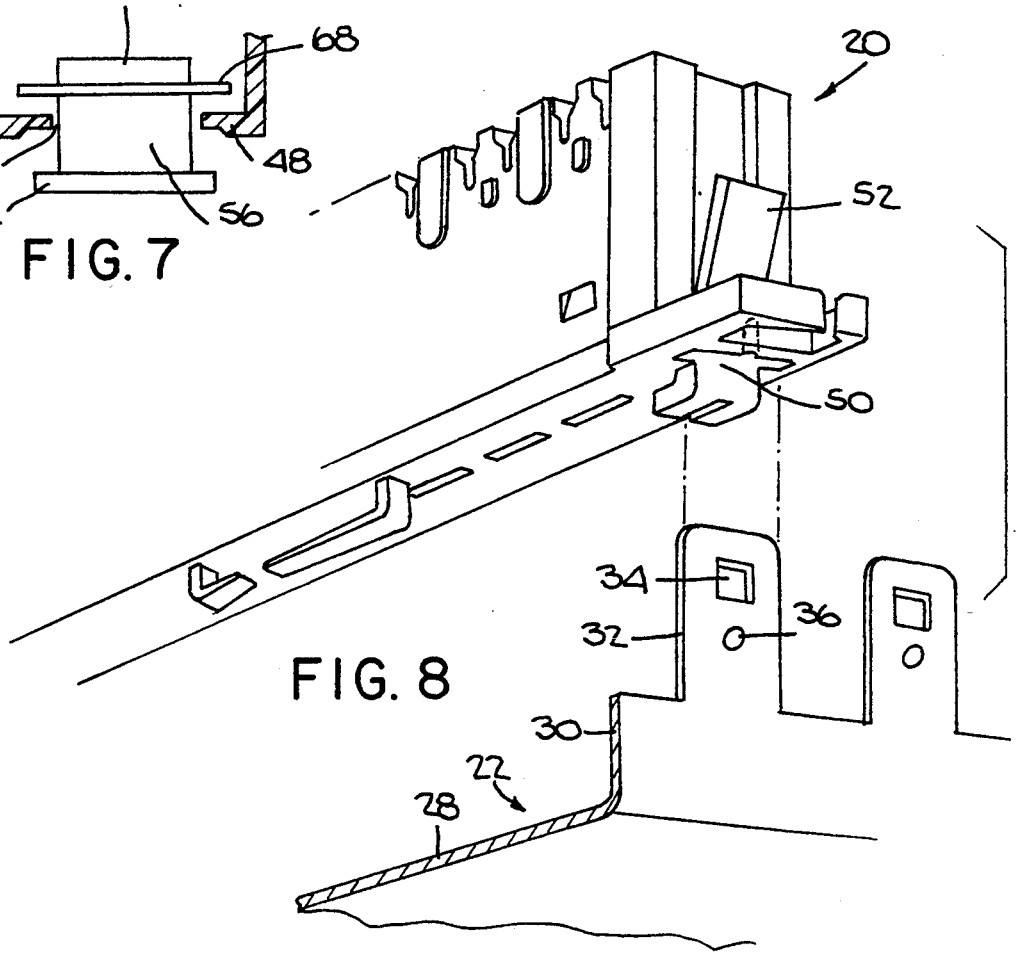
FIG. 8

CONNECTOR BLOCK WITH RELEASABLE MOUNTING

BACKGROUND OF THE INVENTION

1. Field of the Invention

This invention relates to connector blocks used for connecting high density wiring in telecommunications systems and more particularly it concerns novel arrangements for holding such connector blocks securely on mounting brackets yet permitting them to be easily released from the bracket.

2. Description of the Related Art

U.S. Pat. No. 5,160,273 shows and describes a connector block which may be modified according to the present invention. This connector block is an elongated insularire structure with electrical connectors arranged internally thereof. These connectors may be connected to insulated wires which enter the block via slots distributed along both sides of the block. The sides of these slots grip and hold the wires by their insulative covering. Insulation displacement clips located within the block near the slots grip and make electrical contact with the conductive core of the wires. Each clip has a spring finger which may be normally in contact with a spring finger of another clip within the block.

The connector block may be mounted on a tabbed bracket such as shown in either U.S. Pat. No. 4,281,885 or U.S. Pat. No. 4,741,711. The brackets shown in these patents are trough shaped metal brackets with a series of spaced apart mounting tabs extending from the outer edges of each of the side walls thereof. These tabs enter into slots provided near the ends of the connector block. The mounting tabs have locking holes in the center thereof; and when the block is pushed over the tabs, projections inside the slots fit into the locking holes to secure the connector block in place.

A problem occurs when it is desired to remove the above referred to connector blocks from their mounting bracket. This is because the locking projection, which is inside the mounting slot, must be extracted from the locking hole in the mounting tab; and there is no way to gain access to the projection. In general, the connector block was removed by inserting a tool, such as a screwdriver, into the mounting slot and forcing the projection out of the hole in the mounting tab. This was difficult and often caused the block to be distorted or damaged so that it had to be replaced when it was removed from the bracket.

SUMMARY OF THE INVENTION

The present invention overcomes the above described problem and permits a connector block to be mounted in a manner such that it is held securely on its mounting bracket yet is easily removable therefrom without need for special tools and without distortion or damage to the block itself.

In one aspect, the present invention comprises an elongated block of electrically insulative material. The block is formed near an end thereof with a recess into which a mounting bracket tab may extend and an end wall between the recess and the end of the block. A release tab is mounted on one end of the block to extend along the outer surface of the end wall and to be elastically bendable outwardly from the end of the block. The release tab has an interlocking formation which, when the release tab is in its non-bent out position, projects through an opening in the end wall and into the recess where it can engage a cooperative locking formation in a mounting tab within the recess, thereby locking the connector block to the mounting tab. When the release tab is bent back from the end wall, the locking formation becomes at least partially withdrawn from the recess and disengages from the cooperative locking formation thereby releasing the block from the mounting tab.

According to another aspect of the invention, there is provided a novel connector block and mounting bracket assembly which maintains secure mounting of the connector block on the bracket and yet permits the connector block to be easily mounted on and removed from the bracket. The invention in this aspect comprises a mounting bracket and an elongated connector block. The mounting bracket has parallel, spaced-apart mounting tabs; and each tab is formed with a cooperative locking formation. The elongated connector block is formed near each end thereof with a recess into which a mounting bracket tab extends. End walls are formed, respectively, between each end of the connector block and a corresponding recess. Release tabs are mounted on the ends of the block to extend along the outer surfaces of the end walls; and these release tabs are elastically bendable outwardly from the ends of the block. The release tabs each have an interlocking formation which, when the release tab is in its non-bent out position, projects through an opening in the end wall and into the associated recess where it can engage a cooperative locking formation in a mounting tab within the recess, thereby locking the connector block to the mounting tab. When the release tabs are bent back from the end walls, the locking formations become at least partially withdrawn from the recesses and disengage from the cooperative locking formations thereby releasing the block from the mounting tabs.

BRIEF DESCRIPTION OF THE DRAWINGS

FIG. 3 is a side elevational view, partially cut away and partially in section, of the connector block and mounting bracket in their relative positions as in FIG. 1;

FIG. 4 is a view similar to FIG. 3 but showing the connector block and mounting bracket in their relative positions as in FIG. 2;

FIG. 5 is a fragmentary exploded perspective view showing one end of a base and a contact holder portion of the connector block of FIGS. 1–4;

FIG. 6 is an end elevational view of the connector block of FIGS. 1–5;

FIG. 7 is a fragmentary section view taken along line 7—7 of FIG. 6;

FIG. 8 is an exploded fragmentary perspective view taken from a different angle and showing the mounting portions of the connector block and the tabs on the mounting bracket;

DETAILED DESCRIPTION OF THE PREFERRED EMBODIMENT

Figure 1:
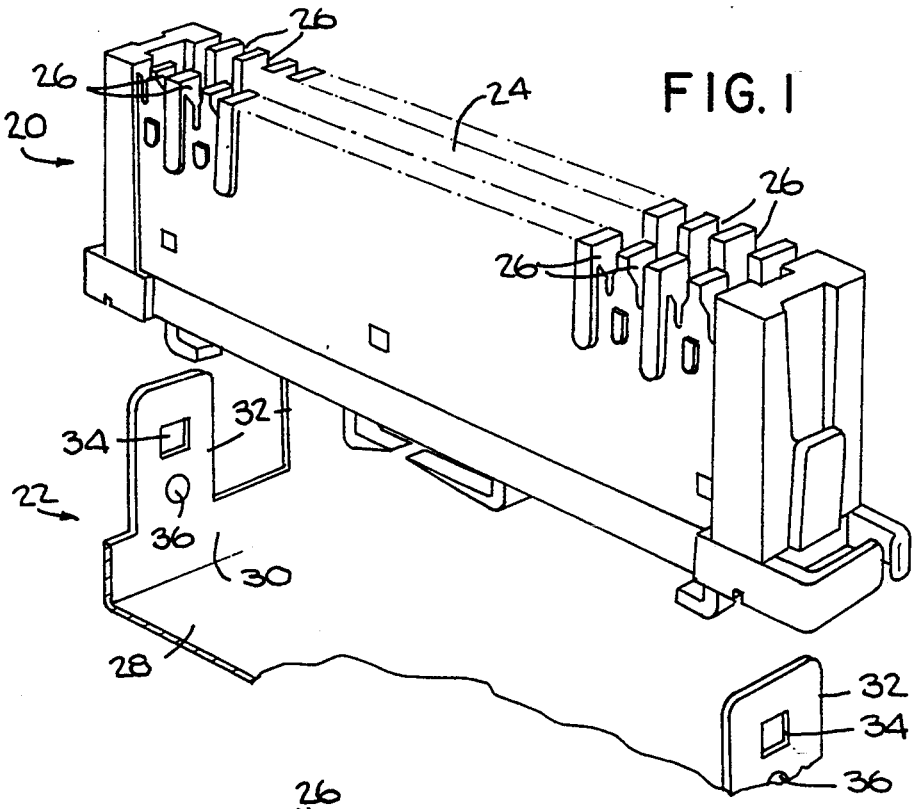
FIG. 1 is a perspective view showing a connector block according to the present invention about to be mounted on a mounting bracket.

As shown in FIG. 1, a connector block 20 is positioned to be mounted on a mounting bracket 22. The connector block is an elongated block shaped member of electrically insulative material such as plastic. Preferably, the block 20 is made of a moldable resin having a high flexure modulus, such as a polycarbonate resin. One such suitable resin is sold under the trademark LEXAN® by the General Electric Company of Fairfield, Conn. The block 20 is formed along its upper portion with an elongated central recess 24 and a plurality of transverse slots 26. The block 20 is hollow and contains internal electrical connector elements (not shown). These connector elements can be accessed by wires (also not shown) which are pressed down into the transverse slots 26. The internal construction of the block is not part of this invention and will not be described in detail herein. However a more detailed description of the internal construction of a connector block of this type is given in U.S. Pat. No. 5,160,273.

Figure 2:
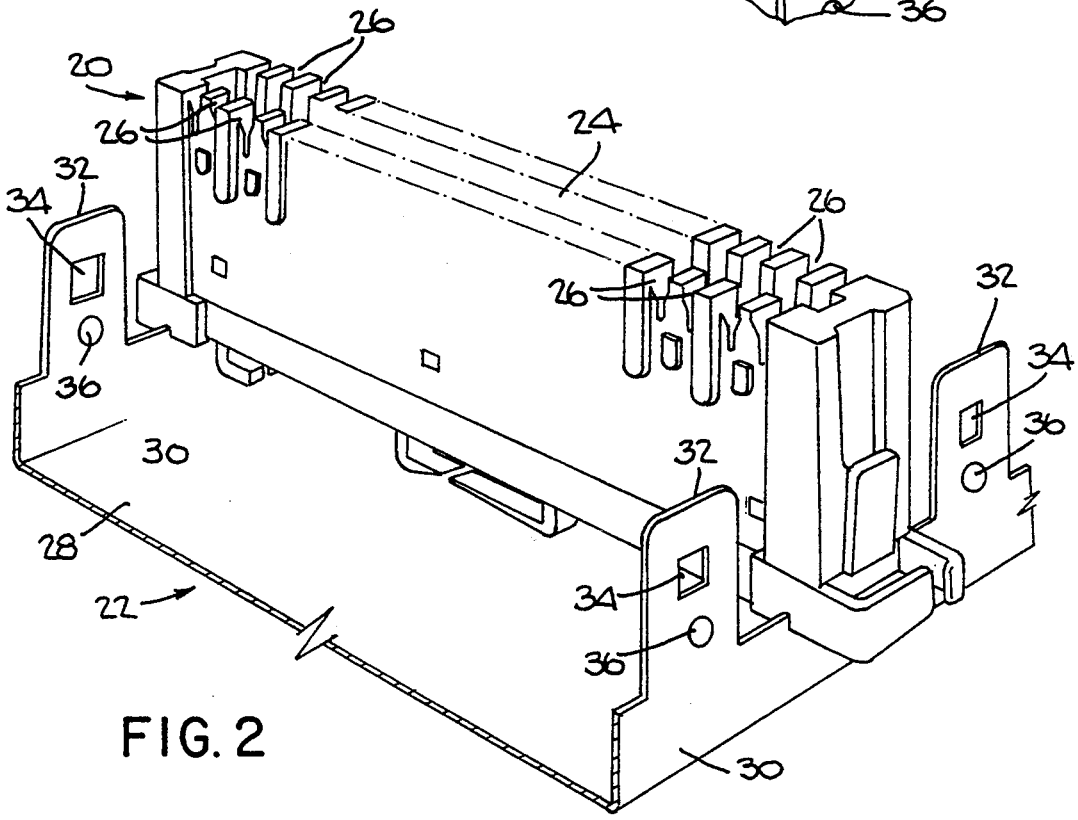
FIG. 2 is a view similar to FIG. 1 but showing the connector block mounted on the mounting bracket.

The mounting bracket 22 is formed of an electrically conductive material, such as stainless steel sheet, which is bent into a trough shape with a bottom wall 28 and a pair of side walls 30. The side walls 30 are spaced apart by a distance equal to the length of the connector block 20. A plurality of spaced apart mounting tabs 32 extend up from the upper edges of the side walls 30. These mounting tabs enter into recesses (described hereinafter) when the connector block 20 is mounted on the mounting bracket 22 as shown in FIG. 2. Although only one connector block is shown in FIGS. 1 and 2, it will be appreciated that several such blocks can be mounted on the mounting tabs 32 of the mounting bracket 22.

The mounting tabs 32 each contain a central locking hole 34 which is used to lock the connector block 20 in place when it is mounted on the mounting tabs 32. The locking holes 34 are shown to be square, but they may be of any other shape. Preferably, their upper edge is straight so as to provide a good locking edge for holding the connector block. The mounting tabs 32 may also be provided with a protrusion 36 or other special shape which is matched to a corresponding shape in the connector block mounting recesses. This arrangement ensures that only particular connector blocks having such special shaped mounting recesses will fit onto the mounting bracket.

Turning now to FIGS. 3 and 4, it will be seen from the cutaway region on the right of each drawing, that the connector block 20 has spring finger signal contacts 38 mounted therein. These signal contacts are formed on the ends of connector elements which extend up into spaces between the transverse slots 26. As mentioned above, these connector elements are connected to wires (not shown) which are pressed down into the slots 26. As explained in U.S. Pat. No. 5,160,273, each spring finger signal contact 38 on one side of the block presses against a corresponding spring finger signal contact 38 on the opposite side of the block. Thus a wire which is connected to a connector element on one side of the block is normally in contact with a wire connected to a connector element on the opposite side of the block. By inserting a card-like insert element between the spring finger signal contacts, the connection between the wires can be broken. Also, the card-like insert element may have electrically conductive segments which contact the spring finger signal contacts to connect them to protection, test or connector devices.

An electrically conductive ground strip 40 is also mounted within the connector block. This ground strip includes spring finger ground contacts 42. Just above each set of spring finger signal contacts 38 and spring finger ground contacts 42, the block 20 is provided with an aperture 44 into which a card-like insert may be inserted to separate the contacts 38 and 42 and/or to connect them with an external device such as an over voltage or excess current protector, a test probe or a patch connection.

The connector block 20 is formed at each end with inner and outer end walls 46 and 48 separated at their upper ends by a top wall portion 49. These end and top walls define a blind mounting recess 50. This recess is shaped to accommodate a mounting tab 32 on the mounting bracket 22 when the connector block is mounted on the bracket, as shown in FIG. 4. The outer end wall 48 has an opening 51 which is covered by a release tab 52. The release tab 52 is fixed to and is integrally connected with a lower portion 48a of the outer end wall 48 by means of a lower hinge 54. This hinge is resilient, so that the release tab 52 may be bent elastically out from the end wall 48. In its normal or unstressed position, the release tab 52 lies against the outer surface of the outer end wall 48 and covers the opening 51 as shown in FIG. 3. However the release tab may be pulled back from the end wall 48 to bend the resilient hinge 54 to a stressed condition.

The release tab 52 also has a locking projection 56 formed on its inner surface. This locking projection extends through the opening 51 and into the recess 50. The locking projection 56 is shaped to fit into and to engage the central locking hole 34 of the mounting tab 32 when the tab is inserted into the recess 50 as shown in FIG. 4. The release tab 52 also has release pull 58 formed on its outer surface. This a release pull 58 is in the form of an outer flange which extends over the adjacent region of the outer end wall 48. This release pull may be engaged by one's finger, or a tool such as a screwdriver, so that the release tab 52 may be pulled back to withdraw the locking projection 56 from the locking hole 34. The connector block 20 is thereby released from the mounting tab 32; and it may then be pulled off from the mounting bracket 22.

A ground contact shim 60, which may be sheet brass or some other resilient, electrically conductive material, may optionally be employed to provide ground connection to the ground strip 40. The shim 60 extends down from a location inside the block where it contacts a downwardly extending end portion 40*a* of the ground strip 40, to a location below the connector block 20 where it contacts the mounting bracket 22 below the mounting tab 32 as shown in FIG. 4. In this arrangement the mounting bracket 22 is made of electrically conductive material and is connected to ground. The ground contact shim 60 extends inside the inner wall 46 of the connector block and is thus physically isolated from the mounting tab 32 of the mounting bracket 22. The lower end of the shim 60 has a bent out formation 62 which extends out and contacts the mounting bracket 22. The mounting bracket may be connected with ground by any well known means.

As shown in FIG. 5, the connector block 20 is an assembly of two portions, namely a base portion 20*a* and a contact holder 20*b*. This allows the various contact elements to be inserted inside the block. The two portions 20*a* and 20*b* are snapped together and held in assembly by means of interlocking projections 64*a* and holes 64*b*. As can be seen, the outer end wall 48 of the contact holder 20*b* has a rectangular cutout 66 which opens at the bottom of the contact holder. This cutout forms the opening 51 (FIGS. 3 and 4) through which the locking projection 56 extends. The release tab 52 and the release tab hinge 54 are formed integrally on the base portion 20*a*. When the base portion and the contact holder are assembled, the release tab 52 extends outside the outer wall 48 and covers the cutout 66 as can be seen in FIG. 6. However, as seen in FIG. 5, the locking projection 56 on the release tab 52 extends through the cutout 66.

As shown in FIG. 7 the locking projection 56 is formed with an inner flange 68 which, when the base 20*a* and the contact holder 20*b* are assembled, extends inside the outer wall 48. This flange engages the inside of the outer wall 48 when the tab 52 is pulled back and it prevents the tab from being pulled back too far. It will also be appreciated that the flange 66 and the outer surface of the release tab 52 will effectively prevent any external access to the mounting tab 32 of the mounting bracket 22.

Figure 9:
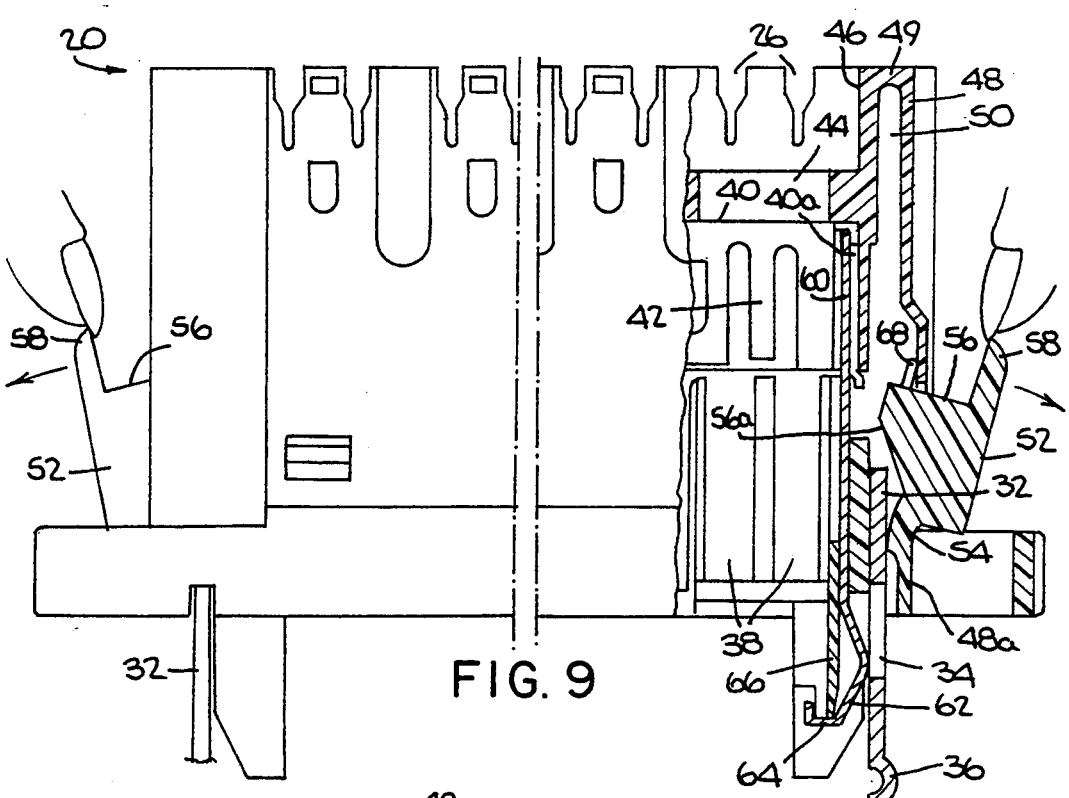
FIG. 9 is a view similar to FIG. 3 but showing locking tabs on the connector block being flexed to an unlock position.

As shown in FIG. 8, the blind recess 50 in the connector block 20 opens at the bottom of the block to accommodate the mounting tab 32 of the mounting bracket 22 when the block 20 is mounted on the bracket 22. To mount the block 20 on the bracket 22, the recess 50 is positioned over a mounting tab 32 and the block is pushed down on the mounting bracket 22 so that the mounting tab 32 enters into the recess 50. Reverting to FIG. 3, it will be seen that the locking projection 56 is formed along its lower edge with a bevel 56*a* which causes the release tab 52 to be cammed back as it engages the top of the mounting tab 32. Because of the resiliency of the hinge 54, the release tab will spring back when the locking projection 56 becomes aligned with and enters into the locking hole 34 in the mounting tab. The upper edge of the locking projection 56 is straight and therefore positively engages the upper edge of the locking hole 34 to hold the block 20 positively locked to the mounting bracket 22. The block may easily be removed, as shown in FIG. 9, by pulling back on the release tab 52 to pull the locking projection 56 out of the locking hole 34 in the mounting tab 32. The block 20 is thus released from the mounting tab 32 and it may then be pulled off from the mounting bracket 22. It will be noted that when the release tab 52 is pulled back, the locking projection 56 is partially withdrawn from the recess 50; but it is limited in this movement by the inner flange 68 which engages the inside surface of the outer wall 48. With the release tabs pulled back as shown in FIG. 9, the connector block 20 may simply be lifted off from the mounting bracket 22.

The construction at the opposite end of the connector block 20 is the same as that described above so that both ends of the block may be locked to the mounting bracket in the same manner.

Figure 10:
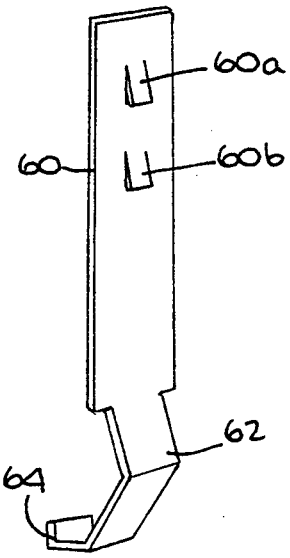
FIG. 10 is a perspective view of a grounding shim used to provide a ground connection from inside the connector block to the mounting bracket.

FIG. 10 shows the overall configuration of the ground contact shim 60. This element is made of electrically conductive resilient sheet material such as spring tempered copper alloy. As can be seen the shim 60 is bent near its lower end to form an outward protruding contact 62 which presses against the mounting bracket 22 below the mounting tabs 32 when the connector block 20 is mounted on the bracket. The ground contact shim 60 is also bent back below the contact 62 to form a hook 64 which, as shown in FIG. 9 fits around a downwardly extending support wall 66 of the connector block 20. The shim 60 is formed near its upper end with upper and lower bent out tabs 60*a* and 60*b*. The lower tab 60*b* fits over the lower edge of an opening 46*a* in the inner wall 46 to lock the shim in place when it is slid up into the block 20 as shown in FIG. 9. The upper tab 60*a* presses against the ground strip 40 to ensure good electrical contact.

Figure 11:
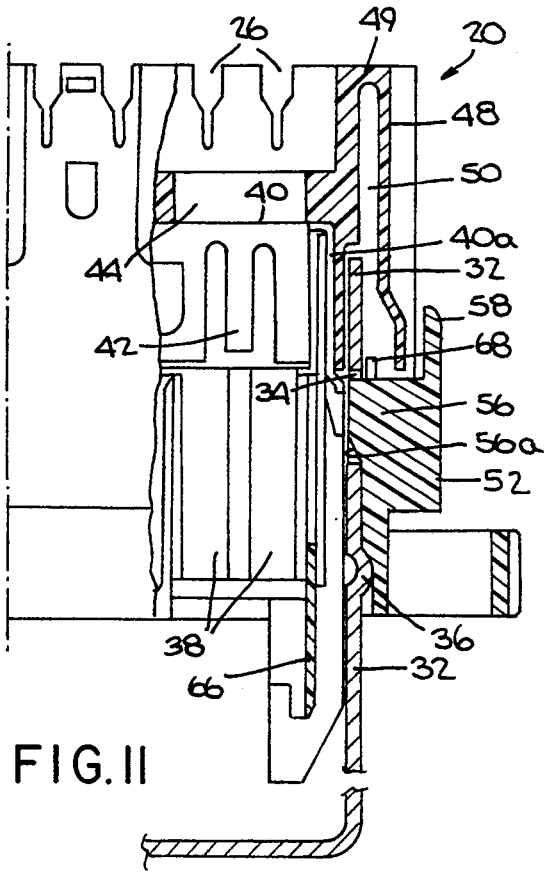
FIG. 11 is a view similar to FIG. 4 but showing the connector block with the grounding shim removed.

The shim 60 is optional. That is, there are applications of the connector block 20 where ground contact is not necessary or desired. In such case, the connector block 20 is mounted on the mounting bracket 22 without any shim 60, as shown in FIG. 11. The shim 60 is constructed so that is can easily be assembled to the connector block 20 when a ground connection to the ground strip 40 is desired. This is accomplished by pushing the shim 60 up along the inside surface of the inner wall 46 so that it contacts the inner surface of the end of the ground strip 40. In this case the ground strip 40 does not have any connection to ground.

It will thus be seen that the connector block locking arrangement described herein permits easy attachment an positive locking to the mounting bracket; and yet it permits the block to be released simply by pulling back on the readily accessible release tabs 52. In addition, the mounting tabs 32 on the mounting bracket 22 are fully enclosed in the recesses 50 of the connector block; and an optional ground connection to the internal ground strip 40 may be provided by inserting the optional ground shim 60 up into the block 20 before it is mounted onto the bracket 22.

We claim:

1. An electrical connector block comprising:

an elongated block of electrically insulative material, said block being formed near an end thereof with a recess into which a mounting bracket tab may extend, and an end wall between the recess and said end of the block; and a release tab mounted on said block to extend along the outer surface of said end wall and to be elastically bendable outwardly therefrom;

said release tab having thereon an interlocking formation which, when the release tab is in a non-bent out position, projects through an opening in the end wall and into the recess to engage a cooperative locking formation in a mounting tab which extends into the recess to lock the connector block to the mounting tab, and which, when the release tab is bent back from the end wall, becomes at least partially withdrawn from the recess to disengage from said cooperative locking formation and release the block.

2. An electrical connector block according to claim 1, wherein said release tab is resiliently biased against said end wall and is bendable against said bias back from said end wall.

3. An electrical connector block according to claim 2, wherein said release tab is integral with said block.

4. An electrical connector block according to claim 1, wherein said release tab extends around and covers said opening on the outer surface of the end wall.

5. An electrical connector block according to claim 1, wherein said release tab is configured to be engaged by an external member which can pull back on and bend the release tab away from the end wall.

6. An electrical connector block according to claim 4, wherein said interlocking formation is formed with an inner flange located inside said recess, said inner flange extending beyond said opening to engage the inner surface of said outer wall when the release tab has been pulled back from the outer wall.

7. An electrical connector block according to claim 1, wherein said recess has a mounting tab entrance opening at one surface of said block and wherein said interlocking formation has an upper surface which faces away from said entrance opening and which extends generally parallel to the direction of movement of said release tab.

8. An electrical connector block according to claim 7, wherein said interlocking formation has a lower surface which is closer to said entrance opening than said upper surface and which is beveled to slant upwardly, away from said entrance opening, in a direction toward the inner wall.

9. An electrical connector block according to claim 1, wherein said block includes a base portion which supports the release tab, and a contact holder portion which fits onto the base portion, said opening being formed as a cutout in the outer wall of the contact holder portion and opening at the edge of the contact portion facing the base portion to straddle the interlocking formation when the base portion is assembled to the contact holder portion.

10. An electrical connector block and mounting assembly comprising:

a mounting bracket;

an elongated electrical connector block;

said mounting bracket having parallel, spaced-apart mounting tabs, each tab being formed with a cooperative locking formation;

said connector block being formed near each end thereof with a recess into which a mounting bracket tab extends, and end walls located, respectively, between each end of the connector block and a corresponding recess; and release tabs mounted on said connector block to extend along the outer surface of said end walls and to be elastically bendable outwardly therefrom;

each said release tab having thereon an interlocking formation which, when the release tab is in a non-bent out position, projects through an opening in the end wall and into the respective recess to engage a cooperative locking formation in a mounting bracket tab which extends into the recess to lock the connector block to the mounting bracket, and which, when the release tab is bent back from the end wall, becomes at least partially withdrawn from the recess to disengage from said cooperative locking formation from the mounting bracket tab and release the block from the mounting bracket.

11. An electrical connector block according to claim 10, wherein said release tab is resiliently biased against said end wall and is bendable against said bias back from said end wall.

12. An electrical connector block and mounting assembly according to claim 11, wherein said release tab is integral with said block.

13. An electrical connector block and mounting assembly according to claim 10, wherein said release tab extends around and covers said opening on the outer surface of the end wall.

14. An electrical connector block and mounting assembly according to claim 10, wherein said release tab is configured to be engaged by an external member which can pull back on and bend the release tab away from the end wall.

15. An electrical connector block and mounting assembly according to claim 13, wherein said interlocking formation is formed with an inner flange located inside said recess, said inner flange extending beyond said opening to engage the inner surface of said outer wall when the release tab has been pulled back from the outer wall.

16. An electrical connector block and mounting assembly according to claim 10, wherein said recess has a mounting tab entrance opening at one surface of said block and wherein said interlocking formation has an upper surface which faces away from said entrance opening and which extends generally parallel to the direction of movement of said release tab.

17. An electrical connector block and mounting assembly according to claim 16, wherein said interlocking formation has a lower surface which is closer to said entrance opening than said upper surface and which is beveled to slant upwardly, away from said entrance opening, in a direction toward the inner wall.

18. An electrical connector block and mounting assembly according to claim 10, wherein said block includes a base portion which supports the release tab, and a contact holder portion which fits onto the base portion, said opening being formed as a cutout in the outer wall of the contact holder portion and opening at the edge of the contact portion facing the base portion to straddle the interlocking formation when the base portion is assembled to the contact holder portion.

19. An electrical connector block and mounting assembly according to claim 10, wherein said mounting tabs each have a hole extending therethrough and wherein each interlocking formation extends into a respective said hole when its release tab is in the non-bent out position.

20. An electrical connector block and mounting assembly according to claim 10, wherein an electrically conductive shim extends into said block and contacts a ground strip therein.

21. An electrical connector block and mounting assembly according to claim 10, wherein said shim extends out from the block and contacts the mounting bracket.

22. An electrical connector block and mounting assembly according to claim 10, wherein said shim has a locking tab bent out therefrom to engage a surface within said block to hold the shim in place.

* * * * *